United States Patent [19]

Klauber

[11] 3,958,274

[45] May 25, 1976

[54] COMBINED PONCHO-MATTRESS

[76] Inventor: Mark Klauber, 16 Lawson Lane, Great Neck, N.Y. 11023

[22] Filed: Oct. 25, 1974

[21] Appl. No.: 517,885

[52] U.S. Cl. ..... 2/69; 2/89; 5/343

[51] Int. Cl.[2] ..... A41D 3/08; A41D 15/04

[58] Field of Search ..... 2/69, 69.5, 88, 89, 2/84; 5/343, 344

[56] References Cited

UNITED STATES PATENTS

| | | | |
|---|---|---|---|
| 1,252,628 | 1/1918 | Terry | 2/89 |
| 1,256,783 | 2/1918 | Fuller | 2/69 X |
| 1,577,586 | 3/1926 | Morehouse | 2/69 X |
| 2,358,410 | 9/1944 | Matthesius | 2/69.5 |
| 2,946,067 | 7/1960 | Wolshin | 5/344 |

*Primary Examiner*—H. Hampton Hunter
*Attorney, Agent, or Firm*—Sydney B. Schlessel

[57] ABSTRACT

A combined poncho-mattress formed of a substantially rectangular main sheet of pliable, air-tight and water-proof material centrally provided with a transverse head slot, on which are centrally mounted a pair of secondary sheets of the same material, with each secondary sheet of reduced width and extending from the head slot to an opposing shorter side of the main sheet, each of the secondary sheets being secured to the main sheet to define a series of parallel expansible sleeves, with an inflatable tube selectively disposable in each sleeve to form, of each secondary sheet and the main sheet, an abutting mattress section, the sleeves being closed off by a transverse zipper. Foam rubber tubes may be substituted for the inflatable tubes. In a modified form the pockets in each mattress section may communicate at alternate ends, for inflation of the mattress section as a single unit, without tube inserts.

7 Claims, 9 Drawing Figures

8
8
12
16
24
26
28
30
32
34
36
38
40
42
50

COMBINED PONCHO-MATTRESS

BACKGROUND OF THE INVENTION a. Field of the Invention

This invention relates to the field of camping and outdoor sleeping equipment, and has for its objective the provision of a poncho adapted to be worn in cold and inclement weather, and which can easily and readily be transformed into a sleeping mattress, or, in an alternate use, serve as a marginal lean-to for protection against cold, wind and rain.

b. Prior Art

In the present state of the art ponchos are worn solely as protective body coverings in cold and inclement weather, and generally consist of a single layer or sheet of air-tight and water-proof material. Alternately, such ponchos are used as a ground cloth to provide a dry sitting surface. Various forms of inflatable mats and mattresses are also found in the present state of the art, wherein such mats and mattresses are inflated to serve as reclining surfaces for sleeping, etc. However, neither such ponchos nor such mats and mattresses are structured or functionable for other than their singular purpose, and where a camper desires both a protective covering in traveling and a supporting surface for sleeping he is required to carry both of these articles as separate units. Those familiar with camping and other outdoor activities are aware that a good deal of equipment of this type must necessarily be carried on the person of the camper, usually in a pack strapped to his back, and the need for reducing the amount and weight of necessary equipment to a minimum is obvious.

BRIEF SUMMARY OF THE INVENTION

The disadvantages of carrying excess weight and equipment, such as a separate mattress and a separate poncho, are overcome by my invention, which provides a poncho adapted to be worn while traveling, and which can be inflated in a portion thereof to form a mattress for sleeping, and which can also be selectively used as a marginal lean-to.

The principal object of my invention, therefore, is to provide a combined poncho-mattress adapted to be worn in deflated state for traveling, and transformable to a resilient mattress for sleeping.

A second important object of my invention lies in the provision of a combined poncho-mattress which may be utilized as a marginal lean-to, when desired.

A third important object of my invention lies in the provision of a combined poncho-mattress, where a pair of such poncho-mattresses can be combined to form a tent.

A fourth important object of my invention lies in the provision of a combined poncho-mattress which is light in weight, and which can easily and quickly be transformed from one use to another.

A fifth important object of my invention lies in the provision of a combined poncho-mattress wherein only the back section of the mattress can be inflated to act as a cushion against the weight and pressure of the pack when strapped to the wearer's back.

Still another important object of my invention lies in the provision of a poncho-mattress of the type described which is simple and inexpensive to manufacture, and of great durability.

These and other salient objects, advantages and functional features of my invention, together with the novel features of construction, composition and arrangement of parts, will become more readily apparent from an examination of the following specification, taken with the accompanying drawings, wherein.

Similar reference characters designate similar parts throughout the different views.

DETAILED DESCRIPTION OF THE INVENTION

Figure 1:
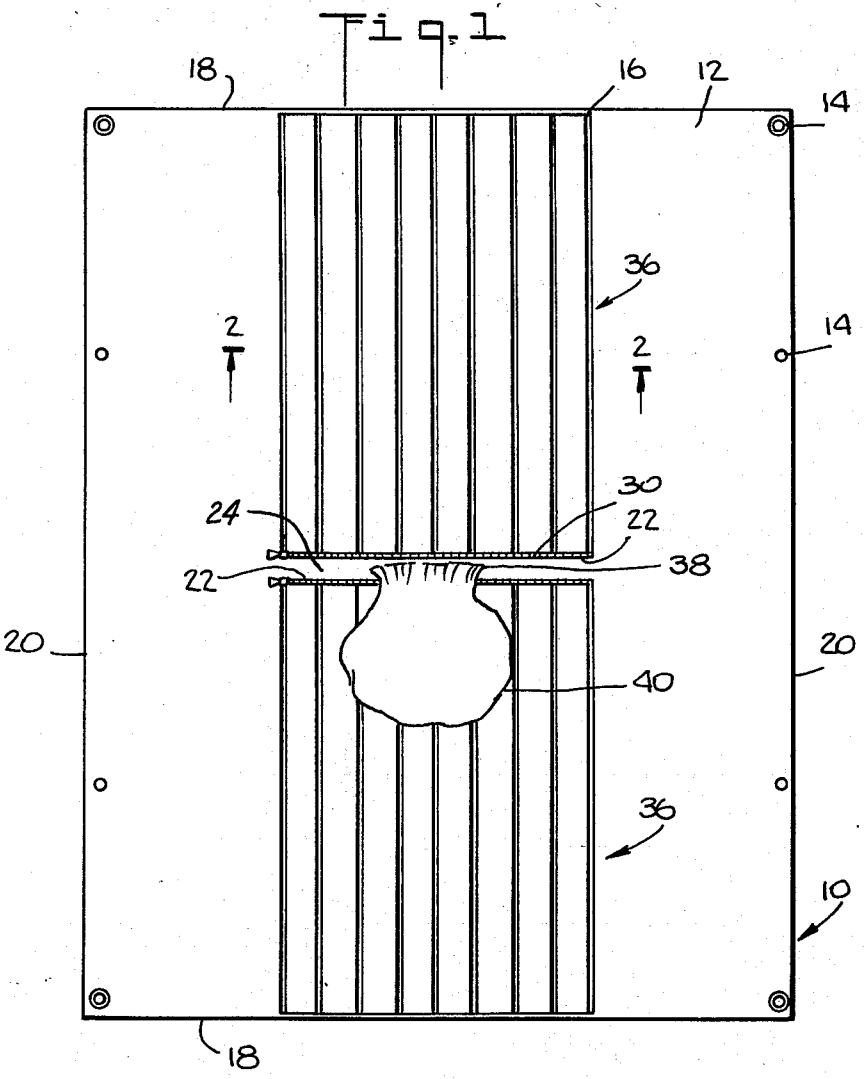
FIG. 1 is a top view of a preferred embodiment of my invention.
Figures 1, 2, 3, 4, 5, 6, 7, 8:
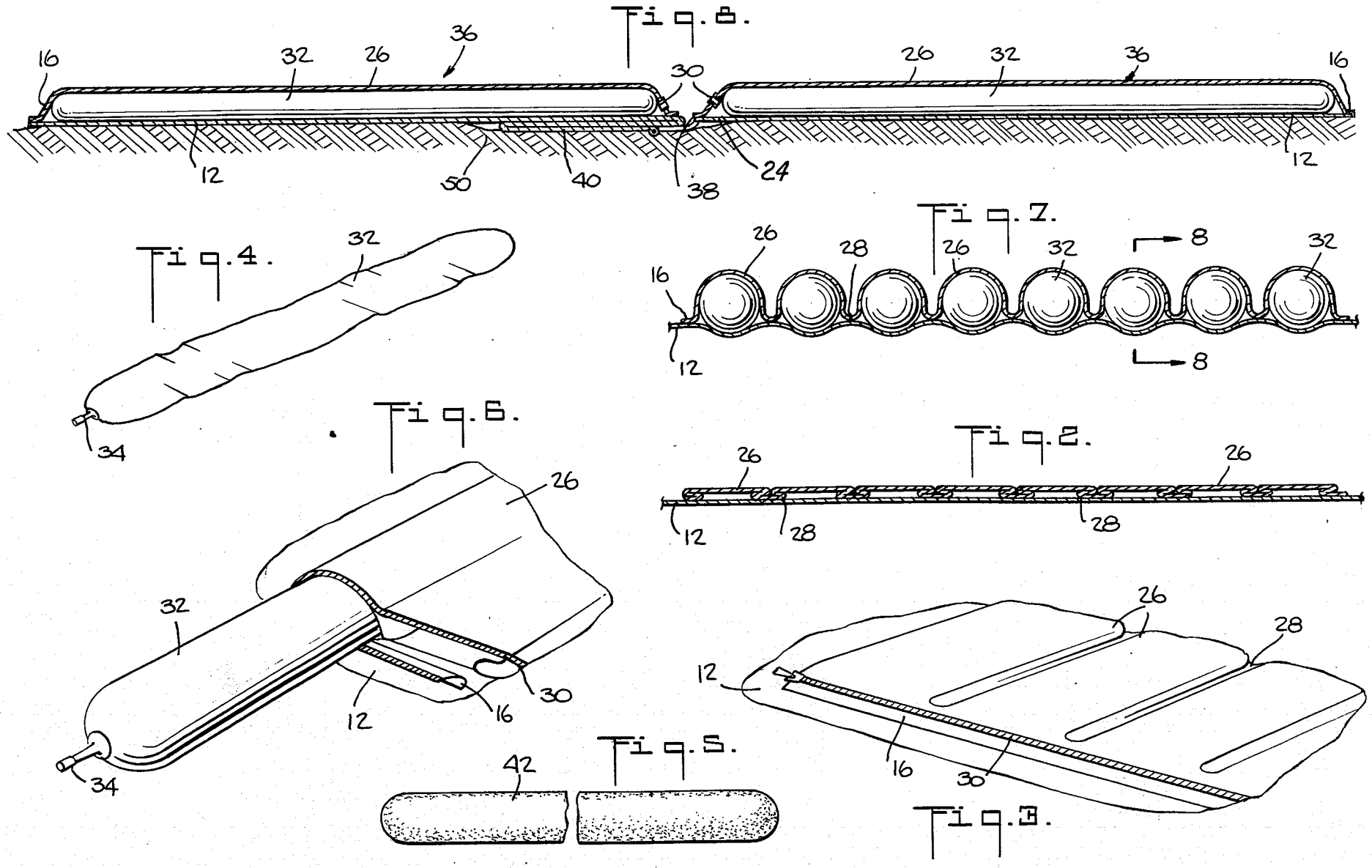
FIG. 2 is an enlarged cross-sectional view, taken on lines 2—2 of FIG. 1.
FIG. 3 is a further enlarged section of one of the mattress units of FIG. 1.
FIG. 4 is a perspective view of one of the inflatable tubes used in the invention.
FIG. 5 is a cross-sectional view of tube used with the invention, composed of a resilient material.
FIG. 6 is a sectional view similar to FIG. 3, but showing the tube of FIG. 4 inserted into one of the sleeves of a mattress unit.
FIG. 7 is a view similar to FIG. 2, but showing the mattress unit in inflated condition.
FIG. 8 is a cross-sectional view, taken on lines 8—8 of FIG. 7.

Illustrative of the embodiment shown by FIGS. 1–8, and preferred, my combined poncho-mattress 10 comprises a substantially rectangular main sheet 12, of a soft, pliable material which is air-tight and water proof, such as rubberized fabric, etc., with a preferred length of 6 feet (1.82 meters), and width of 4½ feet (1.37 meters), although size may vary in accordance with wearer's requirements, the sheet 12 provided with a series of spaced grommets 14 along its longer sides, for purposes to be hereinafter disclosed. Two rectangular sheets 16, of the same material, are secured perimetrically to the sheet 12, so that each sheet 16 extends from one of the shorter edges 18 of sheet 12 towards the other sheet 16, parallel with and spaced from the longer edges 20 of the sheet 12, centrally disposed with respect to said edges 20, as shown, the abutting edges of the sheets 16 being slightly spaced from each other to expose an intermediate portion 24 of sheet 12 therebetween. The sheets 16 are further secured to sheet 12 to form a series of parallel, longitudinal sleeves 26 adapted to be expanded, as shown in FIG. 7, by means of overlapping folds 28 in sheets 16, as shown in FIG. 2, the sheets 16 being thus secured to sheet 12 along the central lines of folds 28. Depending on the nature and adaptability of the material forming sheets 12 and 16, they may be secured together, as above described, by stitching, adhesive, heat-sealing, or any other suitable means.

Referring now to FIGS. 1, 3 and 8, the abutting edges of the sheets 16 are formed with slits opening into the sleeves 26, provided with closure means, such as the zippers 30, although other closure means may be used, such as snaps or the pile and barbs of the material known by the trademark Velcro, by means of which entry into the sleeves 26 may be made, or the sleeves 26 closed off. In combination with the poncho-mattress 10 there are provided a plurality of inflatable tubes 32, equal to the number of sleeves 26, which may be made of rubber, plastic, or the like, with each of the tubes 32 provided with a valve 34 through which air may be introduced into, or expelled from, or retained in, the tubes 32. As shown by FIG. 6, each tube 32, after inflation, is inserted into a sleeve 26, and the zippers 30 closed, thereby to form the inflated mattress sections 36. The width of each mattress section 36 is preferably 2 feet (0.6096 meters) and length slightly less than 3 feet (0.90 meters), the combined sections 36 forming, when placed on a single plane, a complete mattress measuring 2 feet ( 0.6096 meters) by 6 feet (1.8288 meters), suitable for use by the persons of average height.

The intermediate portion 24 of sheet 12 is provided with a transverse head slot 38, through which the wearer's head will protrude when the poncho-mattress 10 is worn as a poncho, and to one side of the slot 38 there is secured the edge of a hood 40 to cover the wearer's head in inclement weather.

Referring now to FIG. 5, instead of the inflatable tubes 32 of FIG. 4, there may be provided a equal number of resilient tubes 42, made of foam rubber or similar material, which may be inserted into the sleeves 26 to form the mattress sections 36.

Coming now to the grommets 14, as shown in FIG. 1, should the camper desire to use the combined poncho-mattress 10 in deflated form as a marginal lean-to, it may be attached to suitable supports to form a rain shield, etc., Where there are two campers, two of the poncho-mattresses 10 may be used in combination, by means of suitable supports, to form a tent.

MODIFIED EMBODIMENT

Figure 9:
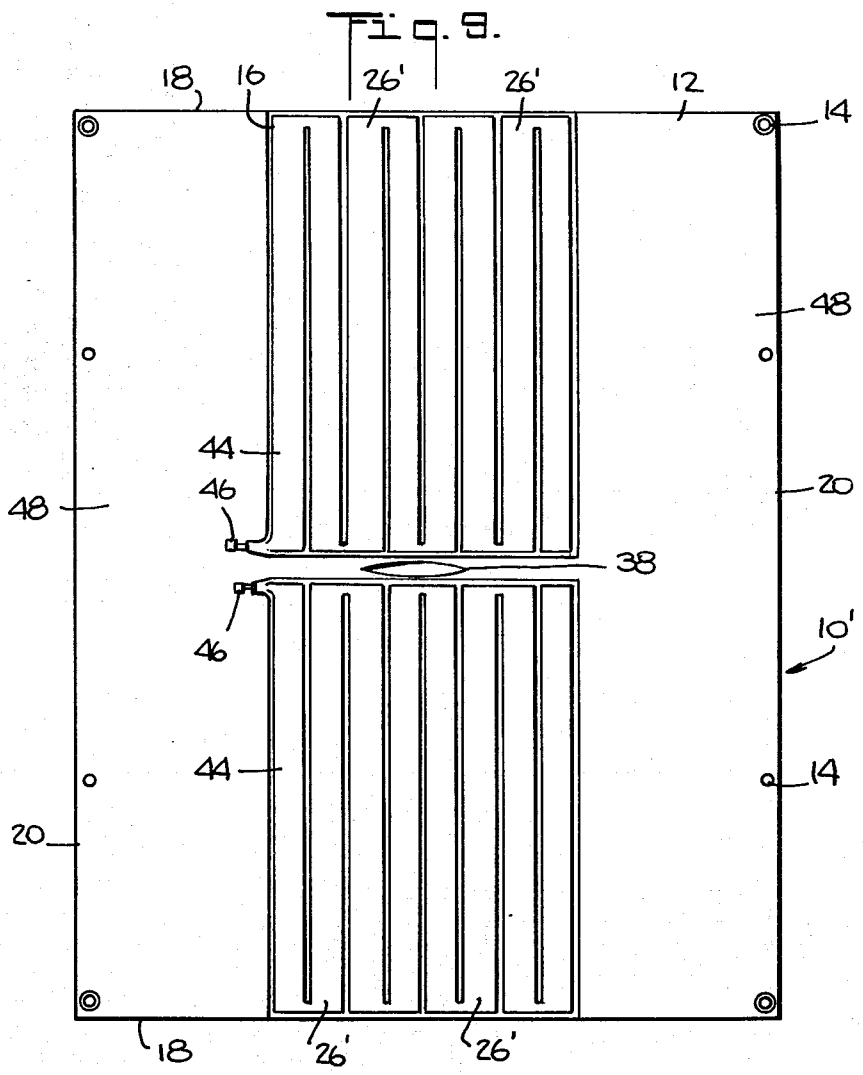
FIG. 9 is a view, similar to FIG. 1, of a modified form of my invention.

Referring now to FIG. 9, there is shown a modified embodiment 10' of my invention. In this embodiment the sleeves 26' are so formed, as by stitching, heat-sealing, etc., so that they open internally into each other at alternate ends, as shown, with end sleeves 44 provided with valves 46, through which the mattress sleeves 26' and 44 may be inflated or deflated, as with an air pump or the user's own wind. While the hood 40 of the preferred embodiment is not shown here, it may be included in the same manner.

OPERATION OF THE INVENTION

In the use of my invention as a poncho the mattress sections 36 are in deflated and flat state, with the tubes 32 carried within the sleeves 26, or separately, as would be necessary with the tubes 42. Of course this is unnecessary with the embodiment of FIG. 9, where no separate tubes are employed. Where desired, the sides of sheet 12 may be secured together, by means of the grommmets 14 and laces or thongs, for greater protection of the sides and arms of the wearer.

When it is desired to use my invention as a mattress, the poncho is taken off and the sections 36 are inflated by insertion of inflated tubes 32, or tubes 42, (or, in the case of the modified embodiment of FIG. 9, by appropriate inflation) into the sleeves 26, and the poncho-mattress 10 or 10' placed upon a flat surface, such as the ground 50 shown in FIG. 8. When used for sleeping, it is to be noted that the sides 48 of sheet 12 may be lapped over the sleeper's body as a covering, and, if desired, so secured by laces or thongs through the corresponding grommets 14.

In a further use of my invention, when worn as a poncho, the rear mattress section 36 may be worn inflated, so as to act as a cusion against the weight and pressure of the pack strapped to the wearer's back.

It is thus to be noted that the embodiments shown and described are by way of illustration and not of limitation, and that various changes may be made in the construction, composition and arrangement of parts without limitation upon or departure from the spirit and scope of the invention, or sacrificing any of the advantages thereof inherent therein, all of which are herein claimed.

Having described my invention, I claim:

1. A combined poncho-mattress, composed of a pliable, air-tight and water-proof material, comprising a substantially rectangular main sheet provided with a central transverse head slot, a secondary sheet extending from each side of the head slot to an opposing shorter edge of the main sheet in aligned relationship with one another, parallel to and spaced from the longer edges of the main sheet, each of the secondary sheets secured to the main sheet to form a series of parallel, expansible sleeves, a transverse opening in each secondary sheet leading into the sleeves, means to selectively close the opening, and means to expand the sleeves to form a resilient mattress.

2. A combined poncho-mattress as described in claim 1, the means to expand the sleeves comprising a plurality of inflatable tubes, with a tube adapted to be removeably disposed within each sleeve, through the transverse openings.

3. A combined poncho-mattress as described in claim 1, the means to expand the sleeves comprising a plurality of resilient tubes, with a tube adapted to be removeably disposed within each sleeve, through the transverse openings.

4. A combined poncho-mattress as described in claim 1, the means to close the opening comprising a zipper.

5. A combined poncho-mattress as described in claim 1, a collapsible hood secured to one side of the transverse head slot.

6. A combined poncho-mattress as described in claim 1, the means to expand the sleeves to form the resilient mattress comprising interior openings in the sleeves affording intercommunication thereinbetween, and an air valve secured to one of the sleeves, whereby air introduced through the valve expands all of the sleeves.

7. A combined poncho-mattress as described in claim 1, a series of grommets provided along each of the longer edges of the main sheet.

* * * * *